US008121324B2

(12) United States Patent
Lamba

(10) Patent No.: US 8,121,324 B2
(45) Date of Patent: Feb. 21, 2012

(54) BEHIND-THE-EAR ACCESSORY MODULE FOR A HELIX HEARING INSTRUMENT

(75) Inventor: Lavlesh Lamba, Piscataway, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 447 days.

(21) Appl. No.: 12/399,318

(22) Filed: Mar. 6, 2009

(65) Prior Publication Data

US 2010/0226517 A1 Sep. 9, 2010

(51) Int. Cl.
*H04R 25/00* (2006.01)

(52) U.S. Cl. ..... 381/321; 381/330
(58) Field of Classification Search ..... 381/321, 381/330
See application file for complete search history.

(56) References Cited

U.S. PATENT DOCUMENTS 7,110,562 B1 * 9/2006 Feeley et al. ..... 381/322
* cited by examiner

*Primary Examiner* — Jasmine Clark
(74) *Attorney, Agent, or Firm* — Francis G Montgomery

(57) ABSTRACT

The capabilities of a helix hearing instrument may expanded with a behind-the-ear accessory module. The module accommodates additional batteries and a variety of accessory functions including an external volume control.

12 Claims, 3 Drawing Sheets

BEHIND-THE-EAR ACCESSORY MODULE FOR A HELIX HEARING INSTRUMENT

BACKGROUND AND SUMMARY OF THE INVENTION

A helix hearing instrument comprises a receiver inserted into the ear canal and an electronics assembly, comprising a microphone, amplifier, and battery, which typically resides in the helix of the user's ear. The helix hearing instrument has a capability limited in part by the size of the electronics assembly and the space available for batteries and the instrument's components. Additional capabilities or functions for the instrument and longer battery life may be offered in an accessory module that rides behind the ear in the same fashion as a behind-the-ear hearing instrument.

DESCRIPTION OF THE INVENTION

Figure 1:
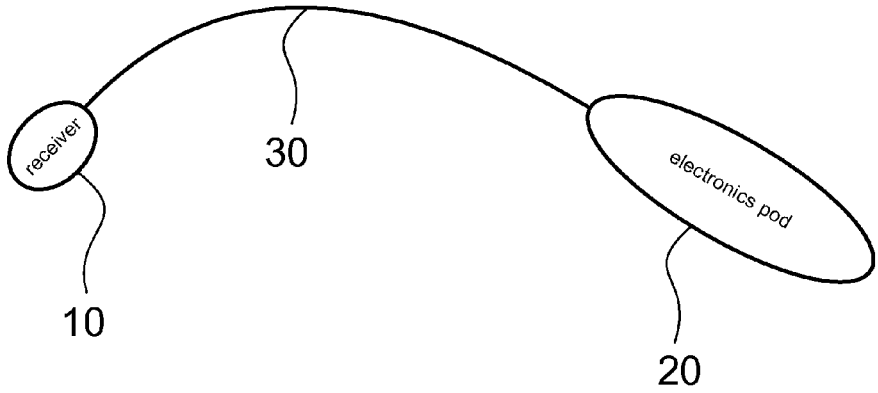
FIG. 1 is a drawing of a helix hearing instrument receiver, electronics pod, and an interconnecting cable.
Figure 2:
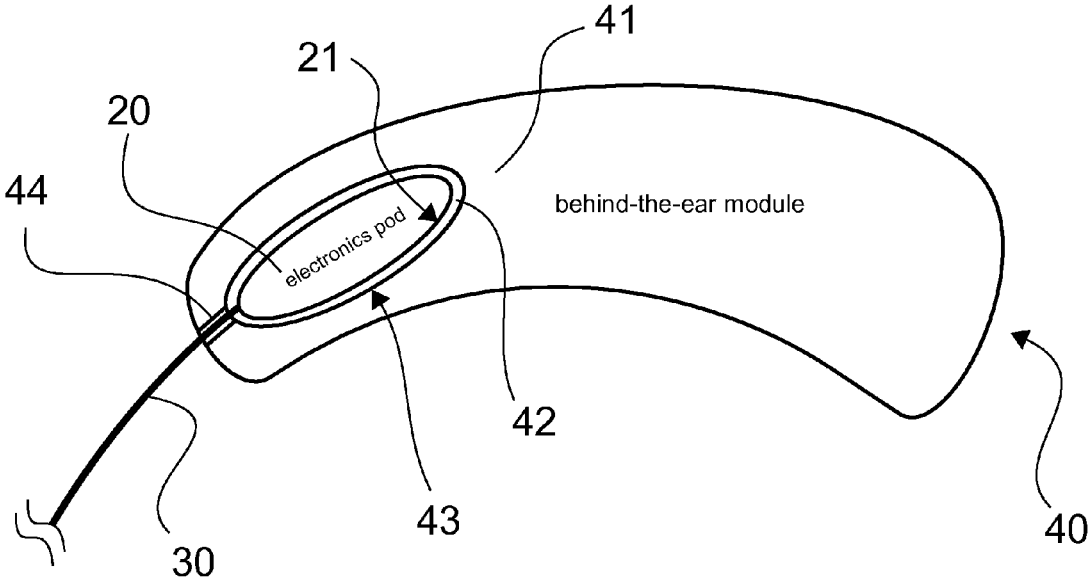
FIG. 2 is a drawing of the helix hearing instrument receiver, electronics pod, and interconnecting cable of FIG. 1, where the electronics pod is connected to a behind-the-ear accessory module.

A helix hearing instrument receiver 10, an electronics pod 20, and an interconnecting cable 30 are shown in FIG. 1. The electronics pod 20 and the connecting cable 30 are shown again in FIG. 2, together with a behind-the-ear accessory module 40. The electronics pod 20 resides in an externally-accessible receptacle 42 formed in the surface 41 of the behind-the-ear accessory module 40 and may be selectively inserted and removed from the receptacle 42. Further, as illustrated in FIG. 2, the inner contour 43 of the receptacle 42 conforms to the outer contour 21 of the electronics pod 20. Detents or similar structures may be used to securely retain the electronics pod 20 in the module receptacle 42. A channel 44 in the accessory module 40 accommodates the interconnecting cable 30.

Figure 3:
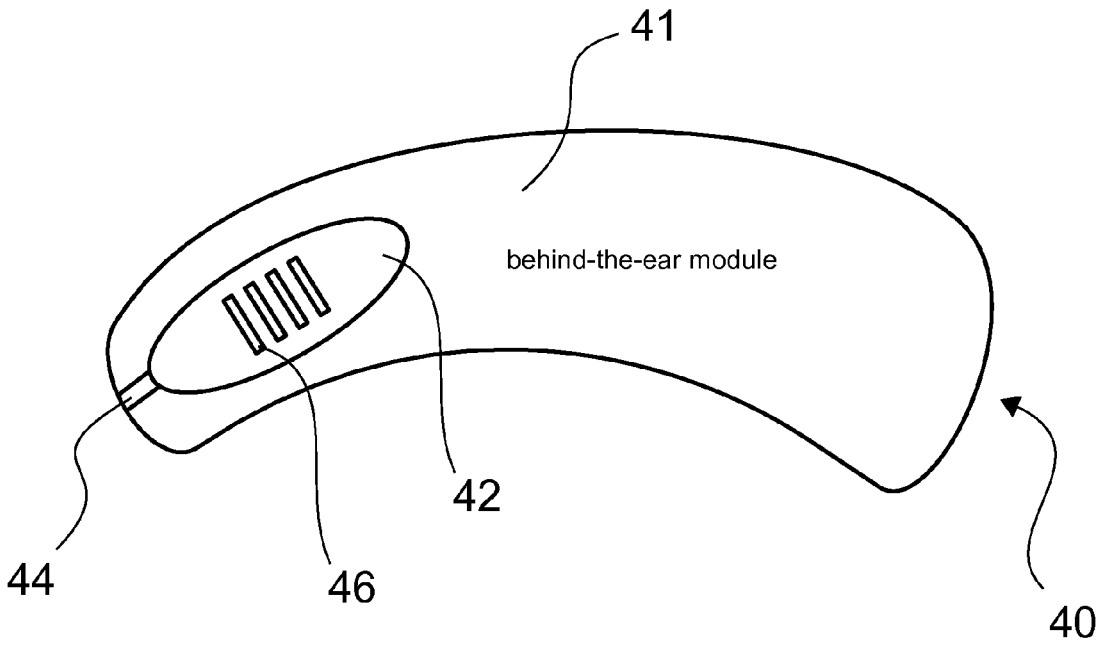
FIG. 3 is a drawing of the behind-the-ear accessory module of FIG. 2.

In FIG. 3, the behind-the-ear accessory module 40 is shown with the electronics pod 20 removed from the module receptacle 42, revealing a set of electrical contacts 46 within the receptacle 42. While four rectangular contacts 46 are shown in the figures, contacts of any quantity, shape, and configuration may be employed.

Figure 4:
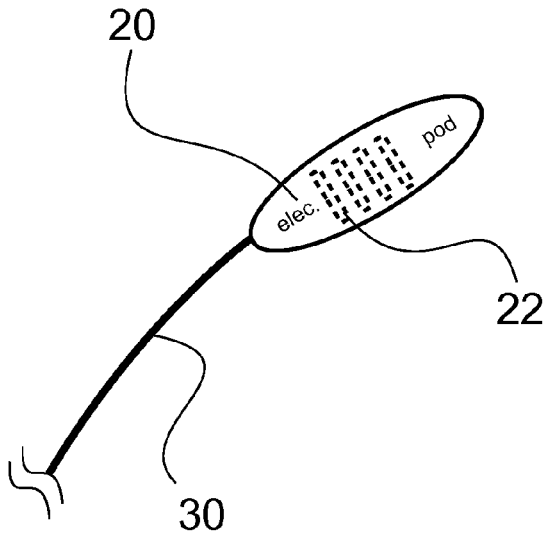
FIG. 4 is a drawing of the helix hearing instrument electronics pod and interconnecting cable of FIG. 1, with electrical contacts shown in phantom.

The electronics pod 20 and the interconnecting cable 30 are shown again in FIG. 4, with a set of complementary contacts 22 shown in phantom. The number, size, and configuration of the electronic pod contacts 22 conforms to the contacts 46 in the behind-the-ear accessory module receptacle 42, but again could assume a different quantity, size, shape, and configuration.

Figure 5:
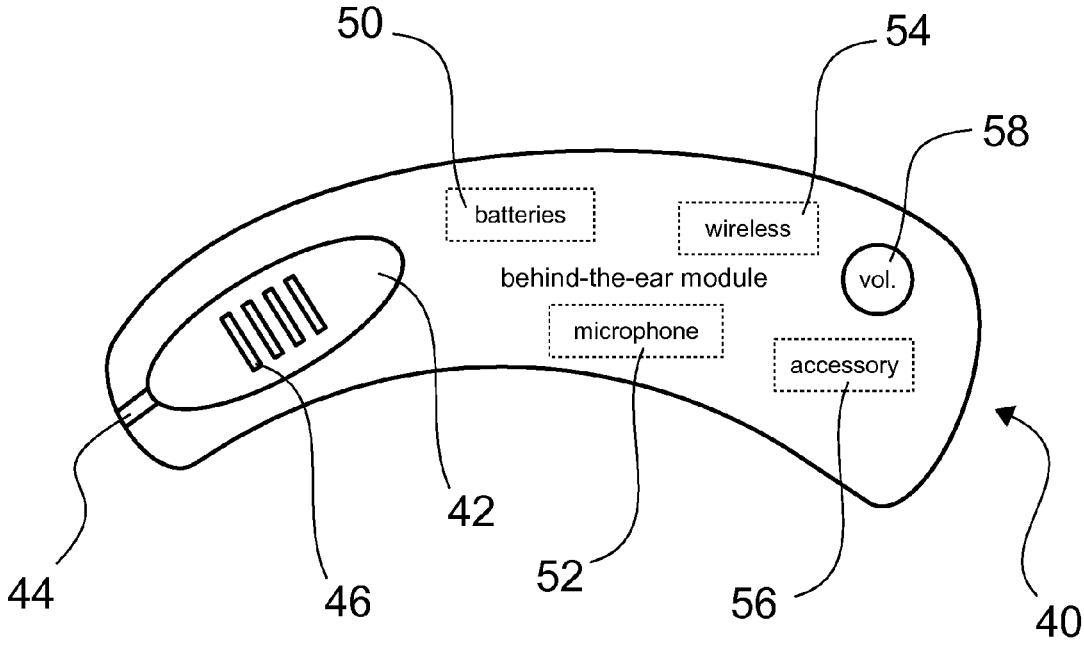
FIG. 5 is a drawing of the behind-the-ear accessory module illustrating internal features and an external volume control.

The behind-the-ear accessory module 40 is shown again in FIG. 5. By way of example, several accessory features are shown within the accessory module 40. These are one or more batteries 50, a microphone 52, wireless capability 54 (e.g., Bluetooth [a trademark of the Bluetooth SIG]), and an unspecified accessory function 56. The drawing also shows an external volume control 58. Although the electronics pod 20 has a microphone (not shown in the drawings), the microphone 52 within the accessory module 40 should be understood to be one of greater functionality, such as a directional microphone.

What is claimed is:

1. A behind-the-ear accessory module for a helix hearing instrument comprising a receiver, a selectively removable electronics pod comprising an outer contour, and an interconnecting cable, the module comprising:

at least one accessory;

an outer surface; and a receptacle in the outer surface of the accessory module for selectively receiving the electronics pod, where the receptacle comprises an inner contour conforming to the outer contour of the electronics pod.

2. A behind-the-ear accessory module as set forth in claim 1, where the receptacle comprises electrical contacts; and the electronics pod comprises complementary electrical contacts that mate with the electrical contacts in the receptacle.

3. A behind-the-ear accessory module as set forth in claim 1, where the accessory comprises a battery.

4. A behind-the-ear accessory module as set forth in claim 1, where the accessory comprises a microphone.

5. A behind-the-ear accessory module as set forth in claim 1, further comprising wireless capability.

6. A behind-the-ear accessory module as set forth in claim 1, further comprising a volume control.

7. A hearing instrument assembly, comprising:

a helix hearing instrument comprising a receiver, a selectively removable electronics pod comprising an outer contour, and an interconnecting cable; and a behind-the-ear accessory module comprising at least one accessory;

an outer surface; and a receptacle in the outer surface of the accessory module for selectively receiving the electronics pod, where the receptacle comprises an inner contour conforming to the outer contour of the electronics pod.

8. A hearing instrument assembly as set forth in claim 7, where the receptacle comprises electrical contacts and the electronics pod comprises complementary electrical contacts that mate with the electrical contacts in the receptacle.

9. A hearing instrument assembly as set forth in claim 7, where the accessory comprises a battery.

10. A hearing instrument assembly as set forth in claim 7, where the accessory comprises a microphone.

11. A hearing instrument assembly as set forth in claim 7, further comprising wireless capability.

12. A hearing instrument assembly as set forth in claim 7, where the behind-the-ear accessory module further comprises a volume control.

* * * * *